US006935845B2

(12) United States Patent
Berner et al.

(10) Patent No.: US 6,935,845 B2
(45) Date of Patent: Aug. 30, 2005

(54) PLURALITY OF VACUUM GENERATION UNITS

(75) Inventors: Michael Berner, Kirchheim (DE); Jürgen Schnatterer, Wolfschlugen (DE)

(73) Assignee: Festo AG & Co., Esslingen (DE)

( * ) Notice: Subject to any disclaimer, the term of this patent is extended or adjusted under 35 U.S.C. 154(b) by 3 days.

(21) Appl. No.: 10/220,156

(22) PCT Filed: Jan. 5, 2001

(86) PCT No.: PCT/EP01/00056

§ 371 (c)(1),
(2), (4) Date: Aug. 23, 2002

(87) PCT Pub. No.: WO01/63129

PCT Pub. Date: Aug. 30, 2001

(65) Prior Publication Data

US 2003/0031566 A1 Feb. 13, 2003

(30) Foreign Application Priority Data

Feb. 26, 2000 (DE) ..... 100 09 164

(51) Int. Cl.[7] ..... F04F 5/00; F04F 5/44; F04B 19/00

(52) U.S. Cl. ..... 417/151; 417/197; 417/198; 417/238

(58) Field of Search ..... 417/151, 178, 417/197, 198, 238, 239

(56) References Cited

U.S. PATENT DOCUMENTS

| | | | | |
|---|---|---|---|---|
| 1,195,915 A | * | 8/1916 | Damrow | 417/151 |
| 1,484,345 A | | 2/1924 | Stoelting | |
| 3,031,127 A | * | 4/1962 | Duhaime | 417/198 |
| 4,861,232 A | | 8/1989 | Ise et al. | |
| 5,556,259 A | * | 9/1996 | Hlavenka | 417/194 |
| 5,954,481 A | * | 9/1999 | Baier et al. | 417/182 |
| 6,042,340 A | * | 3/2000 | Melbourne | 417/151 |
| 6,042,341 A | * | 3/2000 | Richter | 417/151 |
| 6,352,413 B1 | * | 3/2002 | Popov | 417/77 |
| 6,425,378 B1 | | 7/2002 | Frank | |

FOREIGN PATENT DOCUMENTS

| | | |
|---|---|---|
| DE | 239385 | 12/1911 |
| DE | 296 02 454 U1 | 9/1996 |
| DE | 197 27 158 A1 | 7/1999 |
| DE | 198 33 130 a1 | 1/2000 |
| FR | 1007508 | 7/1952 |
| GB | 2 326 696 A | 12/1998 |
| JP | 61061999 | 3/1986 |

* cited by examiner

*Primary Examiner*—Charles G. Freay
(74) *Attorney, Agent, or Firm*—Hoffmann & Baron, LLP

(57) ABSTRACT

A plurality of vacuum producing units capable of being employed together or independently of each other, each have a housing. The housing is internally provided with at least one ejector receiving means fitted with an ejector insert. The housings have the same transverse dimensions of at least one ejector receiving means. Individual vacuum producing units are fitted with different types of ejector inserts in the ejector receiving means for setting different fluid flow paths.

22 Claims, 3 Drawing Sheets

PLURALITY OF VACUUM GENERATION UNITS

This application is the U.S. National Phase of International Application Number PCT/EP01/00056 filed on Jan. 5, 2001, which is incorporated herein by reference.

BACKGROUND OF THE INVENTION

1. Field of the Invention

The invention relates to a plurality of vacuum producing units adapted to be utilized either jointly or independently of each other, which respectively possess a housing, which is internally provided with at least one ejector receiving means fitted with an ejector insert, said housings being the same in design at least as regards the transverse dimensions of at least one ejector receiving means.

2. Description of the Prior Art

The U.S. Pat. No. 4,861,232 discloses a battery or multiplicity of vacuum producing units which respectively serve to produce a vacuum or a negative pressure, which is employed for the handling of articles. Each vacuum producing unit is internally provided with cavities, which include an ejector receiving means, in which an ejector insert is accommodated. During operation compressed air flows through the ejector insert to cause a suction effect at a lateral opening, such suction effect leading to a negative pressure in a suction unit connected therewith, when the unit is applied to an article to be manipulated. The ejector insert accordingly performs the function of a venturi pump.

OBJECT AND SUMMARY OF THE INVENTION

In the prior art the individual vacuum producing units are identical in design and are customized for a limited purpose of application, something which stands in the way of universal use. Accordingly one object of the present invention is to find measures which render possible the production of different types of vacuum producing units in a flexible and economic manner.

In order to achieve this object there is a provision such that in respectively at least one of their ejector receiving means, which are identical as regards the transverse dimensions, the individual vacuum producing units are fitted with different types of ejector inserts setting different fluid flow paths.

On the basis of vacuum producing units, whose housings have ejector receiving means with uniform transverse dimensions and more particularly uniform diameters, it is thus possible to employ ejector inserts, which though they are the same as regards cross section, are however different as regards the fluid flow paths they define and so arrive at different structures. More particularly there is the possibility, for defining the ducts running in the housing of a respective vacuum producing unit—as a rule such ducts will be a feed duct, an outlet duct and a suction duct—to fit an ejector insert in the respective ejector receiving means having the specific fluid flow paths for the fluid which is to flow, as a rule compressed air. This means that vacuum producing units may be manufactured which, owing to being fitted with different types of ejector inserts, render possible varying forms of connection in order in this manner to customize the function of the housing ducts as regards feed, outlet and suction of media.

Further advantageous developments of the invention are defined in the dependent claims.

The housings of the individual vacuum producing units may possess the same external shape in order to render possible uniform structures independently of the manner of functioning, so that for the manufacture thereof identical tools may be employed to a large extent.

The vacuum producing units may be manufactured as separate products. However, there is also the possibility to design the vacuum producing units as components of self-contained fluid power equipment, since the housings thereof are constituted by a component of fluid power means possessing a principal function other than a vacuum producing one. In this case the invention contemplates f. i. the use of a component of a drive means, a valve or a suction unit of a vacuum producing unit as the housing for one or more vacuum producing units.

One or more vacuum producing units may possess a plurality of ejector receiving means of identical cross section in their housings, which are fitted with the same or different types of ejector insert. There is furthermore the possibility of connecting together one or more ejector receiving means, formed in a housing, for fluid transmission in order to perform more complex control functions.

In order to be able to manufacture housings of the vacuum producing units with substantially identical features, it is to be recommended to produce the ejector inserts with at least substantially the same overall length.

Particular advantages as regards manufacture and fitting are to be achieved if the ejector inserts are designed like cartridges and as single structural units are inserted into the respectively associated ejector receiving means. In this case it may however be quite possible to have multi-part ejector inserts, whose components are fitted together prior to fitting together as an ejector cartridge. The fitting of the ejector inserts in the assigned ejector receiving means is preferably performed by insertion from one end of the respective ejector receiving means. In order to do without attachment means, the ejector inserts may be force fitted so that the only fitting of the ejector inserts in the associated ejector receiving means is preferably performed by insertion form an axial end of the respective ejector receiving means. In order to do without additional attachment means, the ejector inserts may be pressed into place and force fitted so that they are only held by frictional engagement.

In order to prevent undesired fluid flow it is preferred to provide the outer peripheries of the ejector inserts with a sealing arrangement comprising one or more seals so that such arrangement cooperates in the inserted state with the inner face of the associated ejector receiving means to provide a sealing action.

As a rule the ejector inserts will be so designed that they have in all three openings for the fluid flowing through them, of which two are located at the two axially opposite ends and one is located in a further lateral region between them. In this respect it is a question of an inlet feed opening, an outlet opening and a suction opening, which respectively may communicate with an inlet feed duct in the associated housing, an outlet duct and a suction duct.

In the case of one possible design of the ejector inserts the end openings may constitute the feed inlet opening and the outlet opening, whereas the lateral opening functions as a suction opening. Flow paths differing from this in the ejector insert are produced in the case of one type, whose axial openings form the inlet feed opening and the suction opening, whereas the lateral opening represents the outlet opening. A further particularly convenient type of ejector insert provides for a suction opening on the side a suction opening and an outlet opening, whereas the lateral opening constitutes the feed opening. This means that, dependent on the particular application in hand, various different forms of connection may be produced by corresponding designs of the ejector insert.

BRIEF DESCRIPTION OF THE DRAWINGS

In the following the invention will be described with reference to the accompanying drawings in detail.

DETAILED DESCRIPTION OF THE PREFERRED EMBODIMENTS

Figure 1:
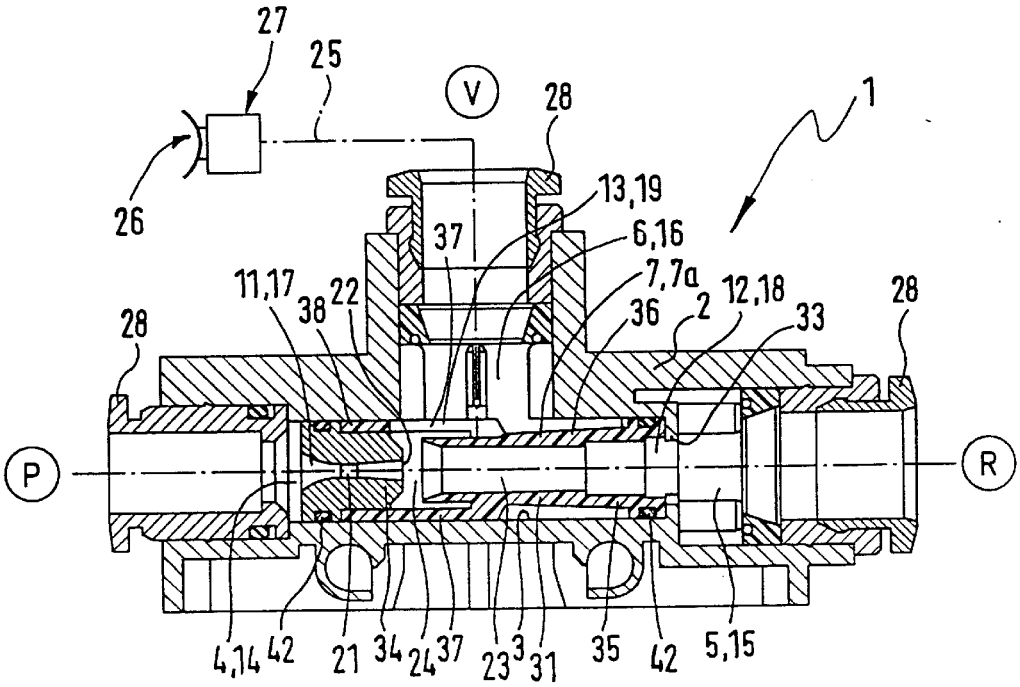
FIG. 1 illustrates a first embodiment of the invention that includes ejector insert 7*a;*

Referring to FIGS. 1 through 5, vacuum producing units 1 in accordance with the present invention may be operated jointly and also independently of each other. The vacuum producing units 1 each possess a housing 2, which in the interior thereof is provided with an elongated cavity, which constitutes an ejector receiving means 3.

The housing 2 may simultaneously be provided with a plurality of ejector receiving means 3, which are placed alongside each other. In the working embodiment illustrated there would be the possibility of accommodating a further ejector receiving means 3 alongside the one already present in that region, which is underneath the plane of the drawing. These ejector receiving means can in case of need be connected together using suitable ducts in order to provide customized functions.

The ejector receiving means 3 of the vacuum producing units 1 illustrated in drawing are in each case cylindrical and preferably circularly cylindrical. Their transverse dimensions are identical and have the same cross sectional shape, the diameters being the same.

Adjoining one axial side of each ejector receiving means 3 there is a first housing duct 4 and on the opposite end side there is an adjoining second housing duct 5. A third housing duct 6 opens laterally into the ejector receiving means 3. All three housing ducts 4, 5 and 6 extend to the outer face of the housing 2 and are accordingly accessible from the outside.

An ejector device is inserted into the interior of each ejector receiving means 3, and is termed an ejector insert 7. This ejector insert 7 possesses an elongated form with a shape at least partially corresponding to the inner shape of the ejector receiving means 3 so that it is fixed in the transverse direction as free of play as possible in the ejector receiving means 3. Preferably the length of the ejector insert 7 is the same as the length of the ejector insert 3 at least approximately. Furthermore, the ejector inserts employed in the individual vacuum producing units preferably have the same overall length.

In the interior the ejector inserts 7 are provided with ducts or, respectively, cavities, which lead to the outer face of the respective ejector insert 7. A first opening 11 and a second opening 12 are arranged on the two axially oppositely aligned end faces of the ejector insert 7 where they communicate with the first and, respectively, second housing duct 4 and 5. A third opening 13 is located in the portion lying axially between the first and the second openings 11 and 12 on the longitudinal side of the ejector insert 7 and is in communication with the third housing duct 6.

Although the ejector inserts are preferably identical as regards their transverse and longitudinal dimensions, they do differ as regards their fluid paths, which are defined by the internal ducts and, respectively, cavities (in the interior of the respective ejector insert 7), communicating with the three openings 11, 12 and 13. Here it is a question therefore of different types or designs of ejector inserts 7, which in the following will be designated with the reference numerals 7*a*, 7*b* and 7*c* to draw a better distinction.

In the case of the arrangement of FIG. 1 the first housing duct 4 constitutes a feed duct 14, by way of which a fluid, under pressure, as a rule compressed air, enters the ejector insert 7*a* through an associated first opening 11. The first opening 11 consequently constitutes a feed opening 17.

Adjoining the feed opening 17 there is an axially running nozzle duct 21, in which the entering pressure medium is accelerated and then exits by way of a nozzle opening 22 at a high speed in order to then enter the axially spaced receiver duct 23, which at the other end has the second opening 12, in the case of which it is consequently a question of an outlet opening 18. Thence the pressure medium flows into the second housing duct constituting an outlet duct 15, by way of which it may be blown off into the atmosphere.

At the transition from the nozzle duct 21 to the spaced receiver nozzle a negative pressure becomes established in the intermediate space 24 and such negative pressure extends as far as the third opening 13 in communication with this intermediate space 24 such opening therefore being able to be termed a suction opening 19. It is connected with the third housing duct 6, which constitutes a suction duct 16, which can be connected by way of a duct 25 (leading to other equipment) with a region 26 which is to be subjected to a vacuum.

The duct 25 leading to other equipment may more particularly be constituted by a rigid or flexible fluid duct. In the case of the region 26 to be evacuated 26 it is for instance the interior space of a suction unit 27, for instance a suction cup. If the suction unit 27 is applied to an object so that its opening is covered over and the interior forming the region 26 to be evacuated, the vacuum will serve to cause the object to be held by the suction unit 27, this rendering possible any desired handling of the object, as for example for conveying it.

The feed of the pressure medium into the feed duct 14 will conveniently take place as well by way of a suitable fluid duct or line, which is not illustrated in detail in the drawing. Moreover the pressure medium exiting by way of outlet duct 15 may leave by way of a connected fluid line.

In order to be able to connect such line easily, in the working example of FIG. 1 all three housing ducts 4, 5 and 6 are associated with suitable securing means 28, which in the present case are preferably designed in the form of plug connection means which permit a releasable attachment of the respective fluid line.

Figure 2:
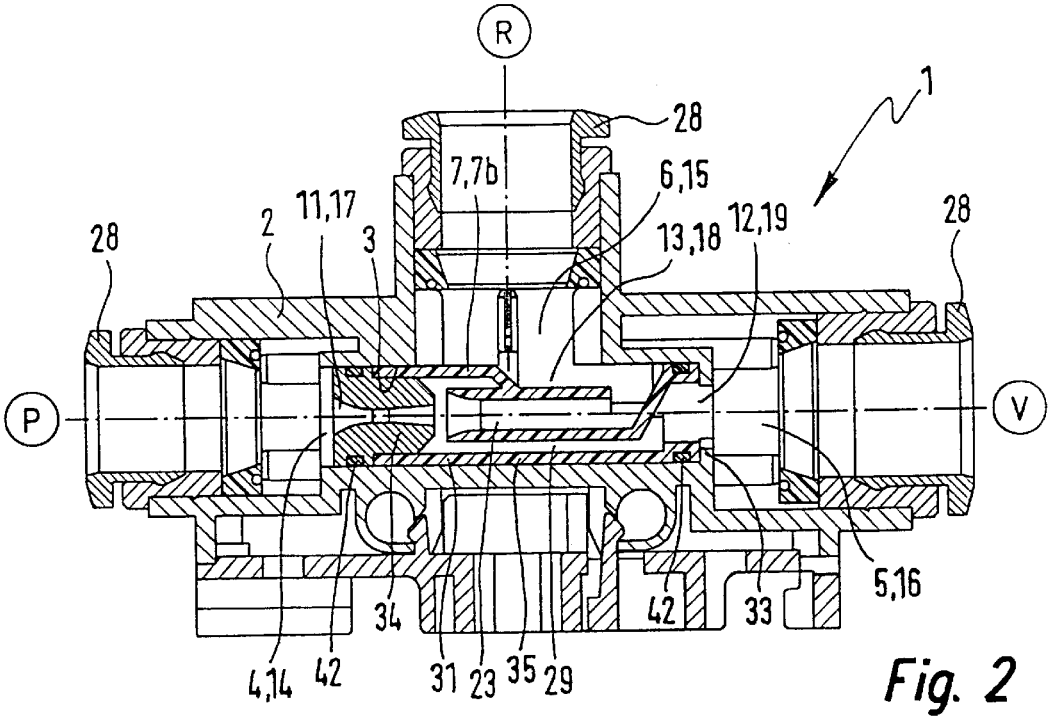
FIG. 2 illustrates a second embodiment of the invention that includes ejector insert 7*b;*
Figure 3:
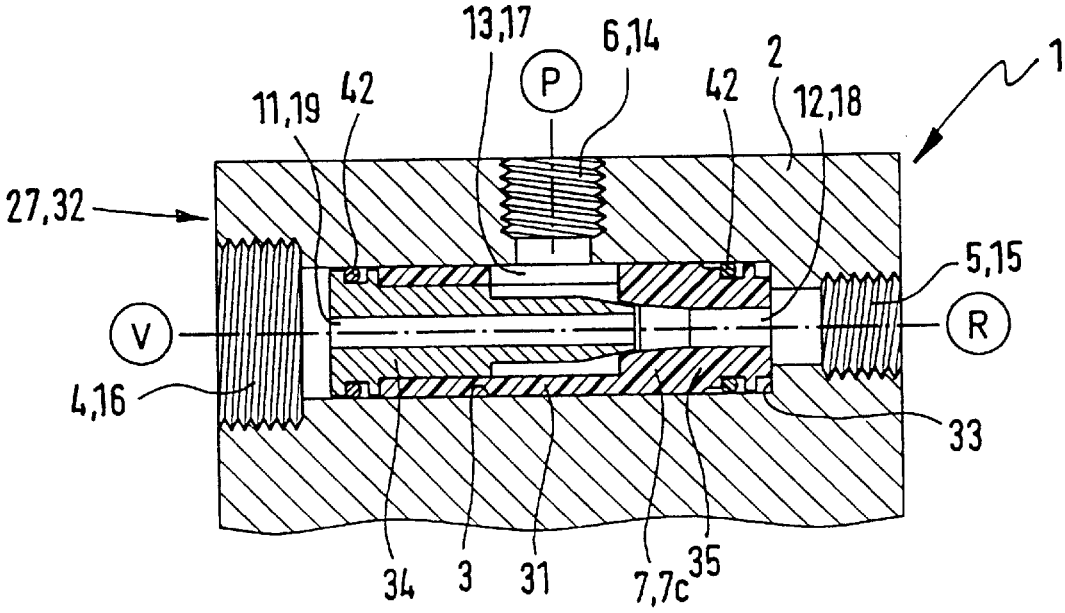
FIG. 3 illustrates a third embodiment of the invention that includes ejector insert 7*c;*
Figure 4:
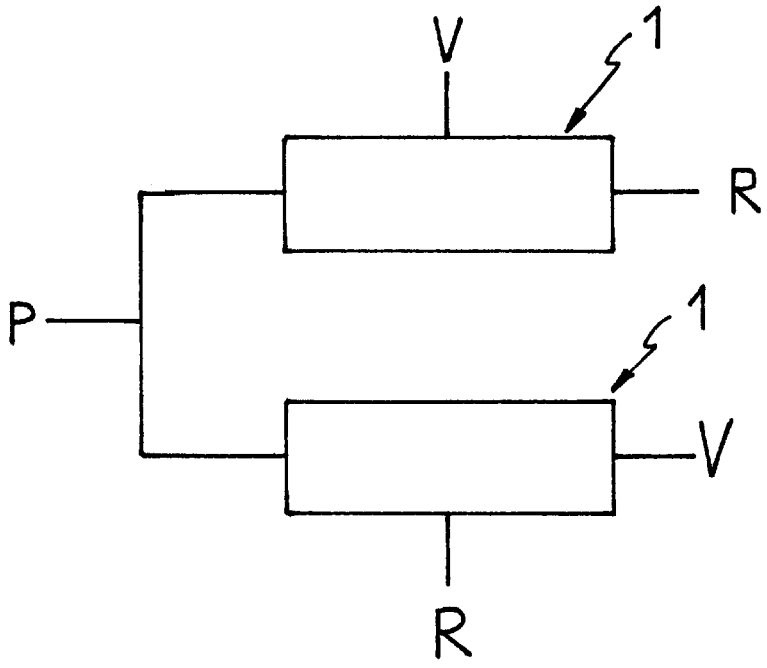
FIG. 4 illustrates a plurality of vacuum producing units in accordance with the present invention being employed together.
Figure 5:
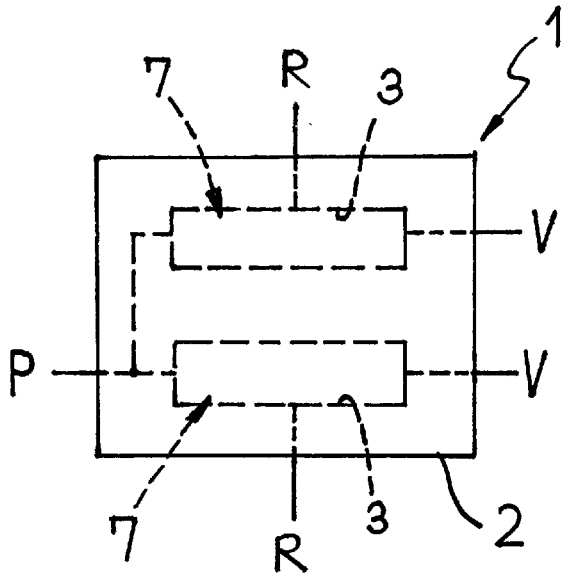
FIG. 5 illustrates a vacuum producing unit which includes a plurality of ejector means in a single housing connected together for fluid flow.

There is also a suitable provision of securing means 28 for the vacuum producing unit 1 of FIG. 2. In contradistinction to this FIG. 3 shows an alternative design, in the case of which the securing means 28 are in the form of a screw thread. The outlet duct 15 may thus be fitted with a muffler, something permitting venting of the compressed air into the surroundings in a quiet manner.

In the working embodiment illustrated FIG. 1 as described the flow in the ejector insert 7*a* is in the form of the pressure medium producing the negative pressure, such flow being axial and linear and the suction effect is at the side. In order to make the drawing more straightforward, the feed region is additionally referenced "P", the outlet region is referenced "R" and the suction region is referenced "V". This also applies for the other figures.

In the case of the ejector insert 7*b* of the vacuum producing unit 1 illustrated in FIG. 2 the first opening 11 again constitutes the feed opening 17. On the contrary, as compared with FIG. 1, the outlet opening 18 and the suction opening 19 are changed over. Accordingly the second opening 12 constitutes the suction opening 19 and the second housing duct 5 represents the suction duct 16. Accordingly the outlet opening 18 is constituted by the third opening 13 and in the case of the third housing duct 6 it is a question of the outlet duct 15.

The manner of functioning of the ejector insert 7*b* in connection with the production of the vacuum is in principle the same as the manner explained above. Owing to the exchange of the said openings there is however a different alignment of the receiver nozzle duct 23, something which means a lateral deflection of the compressed air on flowing through the ejector insert 7*b*. The suction flow is instead of this substantially in the axial direction in the interior of the ejector insert 7*b* past the receiver nozzle duct 23. The corresponding connection duct is referenced at 32.

A further preferred type of ejector insert 7*c* is indicated in FIG. 3. In this case the laterally arranged third opening 13 constitutes the feed opening 17, the third housing duct 6 accordingly forming the feed duct 14. The outlet opening 18 is constituted by the second opening 12, and the suction opening 19 is formed by the first opening 11. Accordingly in this case the outlet duct 15 and the suction duct 16 are axially aligned and constituted by the second and, respectively, first housings 5 and 6.

In the case of vacuum producing unit 1 of FIG. 3 the laterally supplied compressed air is redirected in the ejector insert 7 to flow in the axial direction. The suction flow on the contrary flows through ejector insert 7*b* coaxially.

The first, second and third housing ducts 4, 5 and 6 are so arranged in the different housings 2 that they communicate in certain parts with the respectively associated ejector receiving means 4, such parts being at least approximately identically placed in relation to the respective ejector receiving means within the different housings. Since in the case of the individual ejector inserts 7*a*, 7*b* and 7*c* inter se there is an identical geometry of the first, second and third openings 11, 12 and 13 there is the possibility of fitting one and the same housing 2, as desired, with any of the ejector inserts 7*a*, 7*b* and 7*c* in order as required to have different connection forms and manners of functioning. Irrespectively of the type of inserted ejector insert 7*a*, 7*b* and 7*c* the housing ducts 4, 5 and 6 are connected, taking in account the fluid flow paths set by the respective ejector insert, in the correct association with the openings as predetermined by the ejector insert.

The housings of the individual vacuum producing units 1 may have a single and approximately identical outer shape. There is however also the possibility of producing a plurality of vacuum producing units 1 with identical housings 2, there only being a functional difference owing to fitting with different types of ejector receiving means 3.

FIGS. 1 and 2 show two vacuum producing units 1 as self-contained means, the housings being different in their dimensions. In the case of FIG. 3 on the contrary the housing 2 of the vacuum producing unit 1 is constituted by a fluid power means 32, whose principal function is different to the production of a vacuum. The principal function of this fluid power instrumentality may for example be a drive function, the housing 2 being represented by a component (preferably a housing) of a fluid power drive or a control valve. In the specific case of FIG. 3 it is a question of the housing's being the housing of a suction unit 27 is indicated by the example in FIG. 1, it being more specifically the holder of such suction unit. The ejector insert 7 may therefore be directly integrated in a suction unit 27.

Preferably the ejector inserts 7 are, as in the illustrated working examples cartridge-like in form and may be termed ejector cartridges, which may be inserted by plugging from one axial side into the respective ejector receiving means 3. In the working embodiment it is possible for them to be inserted through the first housing duct 4 into the ejector receiving means 3, the desired final position being set by abutment means on the housing, which project into the insertion path and up against which the ejector insert 7 runs on reaching the desired position. Dependent on the actual design of the ejector inserts 7 it is possible however for other positioning means to be present, which render possible the insertion of the ejector inserts 7 only at a certain angle. It is convenient for the ejector inserts 7 to be so designed that they fulfill their function irrespectively of the angular position.

In the working embodiment the ejector inserts 7 each comprise an elongated ejector body 31, which is composed of two first and second coaxial parts 34 and 35 fitted into each other for some distance. The arrangement is preferably such that these two parts 34 and 35 are fitted together prior to mounting in the ejector receiving means 3, that is to say before insertion into the ejector receiving means 3 they constitute a structural unit. The two parts 34 and 35 may more especially be force fitted together. A screw, adhesive or welded connection would also be possible.

In the case of all ejector inserts 7 the first opening 11 is in the first part 34 and the second opening 12 is in the second part 35. The third opening may, as in the working examples of FIGS. 1 and 3, be defined by intermediate spaces between the two parts 34 and 35, or may also be formed directly in only one of the two parts 34 and 35. In the case of the vacuum producing unit 1 of FIG. 2 the third opening may be in the second part 35.

Preferably in the case of the first part 34 of the ejector body 31 it is a question of a metal part, whereas the second part 35 is manufactured of plastic material.

In the case of advantageous cartridge structure of the ejector insert 7 and 7*a* provided in the case of the vacuum producing unit 1 of FIG. 1 the receiver nozzle duct 23 is located in a body tapering conically from the outside from the outlet opening 18 toward the nozzle opening 12, on whose tapered end region a plurality of holding arms 37, spaced in the peripheral direction, are integrally mounted, which extend toward the first part 34 and again are integrally joined with an annular body 38, which is slipped onto the first part 34 coaxially. The intermediate spaces between the holding arms 37 define the suction opening 19.

It will be clear that the cartridge-like ejector inserts may also be used in the case of individual vacuum producing units 1, the design illustrated in FIG. 1 having special advantages from the point of view of manufacturing and function.

In order to prevent improper flow of the pressure medium each ejector insert 7 is inserted into the associated ejector receiving means 3 in a sealing fashion. For this purpose the ejector insert 7 may, as illustrated, be provided on the outer periphery, with a seal arrangement 42 composed of one or more seals, which engages the inner face of the ejector receiving means 3. The seal arrangement 42 surrounds the ejector body 31 concentrically and may owing to its elastic properties preferably be employed to ensure a frictional locking in position of the ejector inserts 7 in a force fit within the ejector receiving means 3 so that no further attachment means or attachment operations are necessary.

In the case of the working example the seal arrangement 42 has two annular seals arranged with a distance between them, of which one is arranged on the first part 34 and of which the other is arranged on the second part 35 and is more especially held on the respective part in an annular groove therein.

What is claimed is:

1. A plurality of vacuum producing units able to be employed jointly or independently of each other, which respectively have a housing, which is internally fitted with an ejector receiving means which is provided with a feed opening, an outlet opening and a suction opening, said housings being the same in design at least with regard to the transverse dimensions of the ejector receiving means and at least two of said ejector receiving means being fitted with different types of ejector inserts setting different fluid flow paths, said ejector inserts being respectively designed in the form of cartridges and being inserted as a unitary component into the associated ejector receiving means.

2. The plurality of vacuum producing units as set forth in claim 1, wherein the housings of the individual vacuum producing units possess the same external shape.

3. The plurality of vacuum producing units as set forth in claim 1, wherein at least one of the housings of the vacuum producing units is constituted by a component of a fluid power means having exclusively or additionally a principal function other than vacuum producing function.

4. The plurality of vacuum producing units as set forth in claim 3, wherein at least one fluid power means forming a housing of the vacuum producing units is constituted by a valve or materials handling device driven by a fluid and formed by a suction unit.

5. The plurality of vacuum producing units as set forth in claim 1, wherein at least one vacuum producing unit possesses a plurality of ejector receiving means in its housing, which may be connected together for fluid flow.

6. The plurality of vacuum producing units as set forth in claim 1, wherein the different types of ejector inserts have at least generally the same overall length.

7. The plurality of vacuum producing units as set in claim 1, wherein the different types of ejector inserts are respectively inserted by plugging assembly from one axial end face of the housing into the associated ejector receiving means.

8. The plurality of vacuum producing units as set forth in claim 7, wherein the ejector inserts are pressed into the associated ejector receiving means and held therein frictionally.

9. The plurality of vacuum producing units as set forth in claim 1, wherein the ejector inserts are provided on their outer periphery with a sealing arrangement, which cooperates with the inner face of the associated ejector receiving means.

10. The plurality of vacuum producing units as set forth in claim 1, wherein the ejector inserts each comprise an elongated ejector body, which is composed of two first and second coaxial parts fitted into each other for some distance axially.

11. The plurality of vacuum producing units as set forth in claim 1, wherein the ejector insert possesses first and second openings associated with two axially oppositely aligned end sides, and an intermediately placed lateral third opening, which form a feed opening, an outlet opening and a suction opening to accommodate the fluid flowing through the ejector insert.

12. The plurality of vacuum producing units as set forth in claim 11, wherein in the case of one type of ejector insert the flow paths are so defined that the first opening constitutes the feed opening and the third opening constitutes the suction opening.

13. The plurality of vacuum producing units as set forth in claim 1, wherein in the case of one type of the ejector insert the fluid paths are so defined that the first opening constitutes the feed opening, the second opening constitutes the suction opening and the third opening constitutes the outlet opening.

14. The plurality of vacuum producing units as set forth in claim 1, wherein in the case of a type of the ejector insert the flow paths are so defined that the first opening constitutes the suction opening, the second opening constitutes the outlet opening and the third opening constitutes the feed opening.

15. The plurality of vacuum producing units as set forth in claim 1, wherein each vacuum producing unit in its housing is provided with housing ducts which irrespectively of their type of the inserted ejector insert taking into account the fluid path defined by this type are connected with openings in the ejector insert as set by the ejector insert.

16. A plurality of vacuum producing units configured to be employed jointly or independently of each other, each of said plurality of vacuum producing units comprising:

a housing internally fitted with an ejector receiving means, said ejector receiving means having a transverse dimension and being provided with a feed opening, an outlet opening and a suction opening; and an ejector insert formed as a cartridge for insertion into said ejector receiving means, said ejector insert setting a fluid flow path, wherein said transverse dimension for each of said plurality of vacuum producing units are the same and said ejector insert for at least one of said plurality of vacuum producing units is different from another of said plurality of vacuum producing units such that the fluid flow paths associated with the respective ejector inserts are different.

17. The plurality of vacuum producing units as set forth in claim 16, wherein said housing for each of said plurality of vacuum producing units possess the same external shape.

18. The plurality of vacuum producing units as set forth in claim 16, wherein said ejector insert for each of said plurality of vacuum producing units have substantially the same length.

19. The plurality of vacuum producing units as set forth in claim 16, wherein said ejector insert has a first end and a second end and is formed with a plurality of openings including:

a first opening at said first end;

a second opening at said second end; and a third opening between said first end and said second end, wherein said plurality of openings cooperate with said feed opening, said outlet opening and said suction opening to accommodate fluid flowing through said ejector insert.

20. The plurality of vacuum producing units as set forth in claim 19, wherein at least one ejector insert of said plurality of vacuum producing units is configured so that said first opening communicates with said feed opening, said second opening communicates with said outlet opening, and said third opening communicates with said suction opening.

21. The plurality of vacuum producing units as set forth in claim 19, wherein at least one ejector insert of said plurality of vacuum producing units is configured so that said first opening communicates with said feed opening, said second opening communicates with said suction opening, and said third opening communicates with said outlet opening.

22. The plurality of vacuum producing units as set forth in claim 19, wherein at least one ejector insert of said plurality of vacuum producing units is configured so that said first opening communicates with said suction opening, said second opening communicates with said outlet opening, and said third opening communicates with said feed opening.

* * * * *